US006908168B2

(12) United States Patent
Kawaguchi

(10) Patent No.: US 6,908,168 B2
(45) Date of Patent: Jun. 21, 2005

(54) INKJET PRINTING APPARATUS, INKJET PRINTING METHOD AND PROGRAM

(75) Inventor: Koichiro Kawaguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/642,757

(22) Filed: Aug. 19, 2003

(65) Prior Publication Data

US 2004/0036728 A1 Feb. 26, 2004

(30) Foreign Application Priority Data

Aug. 21, 2002 (JP) ..... 2002-241059

(51) Int. Cl.[7] ..... B41J 29/38; B41J 2/145

(52) U.S. Cl. ..... 347/12; 347/41; 347/42; 347/43; 347/104

(58) Field of Search ..... 347/12, 13, 14, 347/40, 41, 42, 43, 9, 16, 104

(56) References Cited

U.S. PATENT DOCUMENTS 5,376,958 A * 12/1994 Richtsmeier et al. ..... 347/104
5,959,646 A * 9/1999 Bates et al. ..... 347/43
6,022,096 A * 2/2000 Hirasawa et al. ..... 347/43
6,550,884 B2 * 4/2003 Gudaitis et al. ..... 347/16
6,565,190 B1 * 5/2003 Nobel et al. ..... 347/40
6,575,568 B1 * 6/2003 Hiramatsu et al. ..... 347/104
6,629,752 B1 * 10/2003 Mayo et al. ..... 347/41
2002/0054305 A1 5/2002 Ogasahara et al.

FOREIGN PATENT DOCUMENTS

JP 2002-144637 5/2002

* cited by examiner

*Primary Examiner*—Eugene H. Eickholt
(74) *Attorney, Agent, or Firm*—Fitzpatrick, Cella, Harper & Scinto

(57) ABSTRACT

An inkjet printing apparatus includes a transportation roller unit and discharging roller units to transport printing media. When printing an image on a front end portion of the printing medium, ink is ejected from a partial number of nozzles of a print head on a side near to the transportation roller unit. When the printing medium is transported by both the transportation roller unit and the discharging roller unit, ink is ejected from all the nozzles of the print head. When printing an image on a rear end portion of the printing medium, ink is ejected from a partial number of nozzles of a print head on a side near to the discharging roller unit.

19 Claims, 10 Drawing Sheets

INKJET PRINTING APPARATUS, INKJET PRINTING METHOD AND PROGRAM

This application claims priority from Japanese Patent Application No. 2002-241059 filed Aug. 21, 2002, which is incorporated hereinto by reference.

BACKGROUND OF THE INVENTION

Field of the Invention

The present invention relates to an inkjet printing apparatus, an inkjet printing method and a program.

DESCRIPTION OF THE RELATED ART

In general, an inkjet printing apparatus includes two sets of roller units arranged on the upstream side and the downstream side of a print head as a mechanism for transporting printing medium. By these roller units, the printing medium is transported in a predetermined amount corresponding to the printing operation of the print head. The roller unit (a transportation roller unit) on the upstream side of the print head includes a transportation roller that is rotationally driven by a driving unit and a pinch roller that generates a transportation force by pressing a printing medium against the transportation roller. The roller unit (a discharging roller unit) on the downstream side of the print head includes a discharging roller that is rotationally driven by a driving unit and a spur for pressing the printing medium against the discharging roller.

In the case of performing an ordinary printing operation, a printing medium is held and transported by the transportation roller unit and the discharging roller unit. On the other hand, in the case of printing an image on the front end portion or the rear end portion of the printing medium, the printing medium is held and transported only by one of the transportation roller unit and the discharging roller unit. Accordingly, when printing an image on the front end portion or the rear end portion of the printing medium (that is, when printing an image on the printing medium that is held and transported only by one of the transportation roller unit and the discharging roller unit), there has been a problem that the accuracy in transportation of the printing medium is lowered and the image formed on the printing medium become degraded. A method for reducing this problem is disclosed in Japanese Patent Application Laid-open No. 2002-144637 for example. In this method, the number of nozzles to be used for printing an image on the front and rear end portions of a printing medium is decreased in comparison with the number of nozzles to be used for the ordinary printing.

However, even when an image is printed on the end portions of the printing medium by the method disclosed in Japanese Patent Application Laid-open No. 2002-144637, it is only that the degradation of the image formed on the medium becomes a little less remarkable, and such a degradation of the image itself is not reduced. Therefore, it is required to improve the quality of an image on the front end portion or the rear end portion of the printing medium (on the printing medium held and transported only by one of the transportation roller unit and the discharging roller unit).

Further, with the recent rapid penetration of digital cameras and the like, needs of printing images with a quality as high as silver salt photographs on the entire surfaces of printing medium, in other words, without margins (Borderless) are becoming greater and greater. To satisfy such needs, the quality of images on the front end or the rear end of the printing medium by borderless printing is needed to be improved more.

The present invention is directed to overcome one or more of the problems as set forth above.

SUMMARY OF THE INVENTION

The inkjet printing apparatus of the present invention is an inkjet printing apparatus capable of printing an image on a printing medium by performing an operation for ejecting ink from a print head including a plurality of nozzles onto the printing medium in accordance with print data while moving the print head and an operation for feeding a printing medium in a direction substantially perpendicular to a direction in which the print head is moved, the apparatus comprising: a roller unit for transporting the printing medium, wherein ink is ejected from a partial number of nozzles on a side near to the roller unit which transports the printing medium when printing an image on both a front end portion and a rear end portion of the printing medium.

Another inkjet printing apparatus of the present invention is an inkjet printing apparatus capable of printing an image on a printing medium by ejecting ink in accordance with print data from a print head including a plurality of nozzles, comprising: a first roller unit for holding and transporting the printing medium, the first roller unit disposed on an upstream side of the print head in a direction in which the printing medium is transported; a second roller unit for holding and transporting the printing medium, the second roller unit disposed on a downstream side of the print head in a direction in which the printing medium is transported; wherein ink is ejected from a partial number of nozzles on a side near to the first roller unit when only the first roller unit holds the printing medium for printing, and wherein ink is ejected from a partial number of nozzles on a side near to the second roller unit when only the second roller unit holds the printing medium for printing.

Another inkjet printing apparatus of the present invention is an inkjet printing apparatus capable of printing an image on a printing medium by ejecting ink in accordance with print data from a print head including a plurality of nozzles, comprising: a first roller unit for holding and transporting the printing medium, the first roller unit disposed on an upstream side of the print head in a direction in which the printing medium is transported; a second roller unit for holding and transporting the printing medium, the second roller unit disposed on a downstream side of the print head in a direction in which the printing medium is transported; and a determining means for determining nozzles being allowed to eject ink in accordance with a position of the printing medium in a transporting path; wherein the determining means determining a partial number of nozzles on a side near to the first roller unit as the nozzles being allowed to eject ink when the printing medium is positioned to be held only by the first roller unit, and wherein the determining means determining a partial number of nozzles near to the first roller unit and a partial number of nozzles near to the second roller unit as the nozzles being allowed to eject ink when the printing medium is positioned to be held by both the first roller unit and the second roller unit, and wherein the determining means determining a partial number of nozzles on a side near to the second roller unit as the nozzles being allowed to eject ink when the printing medium is positioned to be held only by the second roller unit.

Another inkjet printing apparatus of the present invention is an inkjet printing apparatus capable of printing an image on a printing medium by ejecting ink in accordance with print data from a print head including a plurality of nozzles, comprising: a roller unit for holding and transporting the printing medium, wherein ink is ejected from a partial number of nozzles on a side near to the roller unit which holds the printing medium when printing an image on both a front end portion and a rear end portion of the printing medium.

The inkjet printing method of the present invention is an inkjet printing method comprising a step of: printing an image on a printing medium by performing an operation for ejecting ink from a print head including a plurality of nozzles onto the printing medium in accordance with print data while moving the print head and an operation for feeding a printing medium in a direction substantially perpendicular to a direction in which the print head is moved, wherein ink is ejected from a partial number of nozzles on a side near to a roller unit which transports the printing medium when printing an image on both a front end portion and a rear end portion of the printing medium.

Another inkjet printing method of the present invention is an inkjet printing method for printing an image on a printing medium by ejecting ink in accordance with print data from a print head including a plurality of nozzles, comprising the steps of: holding and transporting the printing medium by a first roller unit disposed on an upstream side of the print head in a direction in which the print head is transported; holding and transporting the printing medium by a second roller unit disposed on a downstream side of the print head in a direction in which the printing medium is transported; ejecting ink from a partial number of nozzles on a side near to the first roller unit when only the first roller unit holds the printing medium for printing; and ejecting ink from a partial number of nozzles on a side near to the second roller unit when only the second roller unit holds the printing medium for printing.

Another inkjet printing method of the present invention is an inkjet printing method for printing an image on a printing medium by ejecting ink in accordance with print data from a print head including a plurality of nozzles, comprising the steps of: holding and transporting the printing medium by a first roller unit disposed on an upstream side of the print head in a direction in which the printing medium is transported; holding and transporting the printing medium by a second roller unit disposed on a downstream side of the print head in a direction in which the printing medium is transported; and determining nozzles being allowed to eject ink in accordance with a position of the printing medium in a transporting path, the determining step including the steps of: (a) determining a partial number of nozzles on a side near to the first roller unit as the nozzles being allowed to eject ink when the printing medium is positioned to be held only by the first roller unit; (b) determining a partial number of nozzles near to the first roller unit and a partial number of nozzles near to the second roller unit as the nozzles being allowed to eject ink when the printing medium is positioned to be held by both the first roller unit and the second roller unit; and (c) determining a partial number of nozzles on a side near to the second roller unit as the nozzles being allowed to eject ink when the printing medium is positioned to be held only by the second roller unit.

Another inkjet printing method of the present invention is an inkjet printing method for printing an image on a printing medium by ejecting ink in accordance with print data from a printhead including a plurality of nozzles, comprising a step of: ejecting ink from a partial number of nozzles on a side near to a roller unit which holds the printing medium when printing an image on both a front end portion and a rear end portion of the printing medium.

The program of the present invention is a program for controlling an inkjet printing apparatus including a roller unit for transporting a printing medium and capable of printing an image on a printing medium transported by the roller unit by ejecting ink in accordance with print data from a print head including a plurality of nozzles, the program comprising: computer-readable program code means for generating ink ejection data so that ink is ejected from a partial number of nozzles on a side near to the roller unit which holds the printing medium when printing an image on both a front end portion and a rear end portion of the printing medium.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
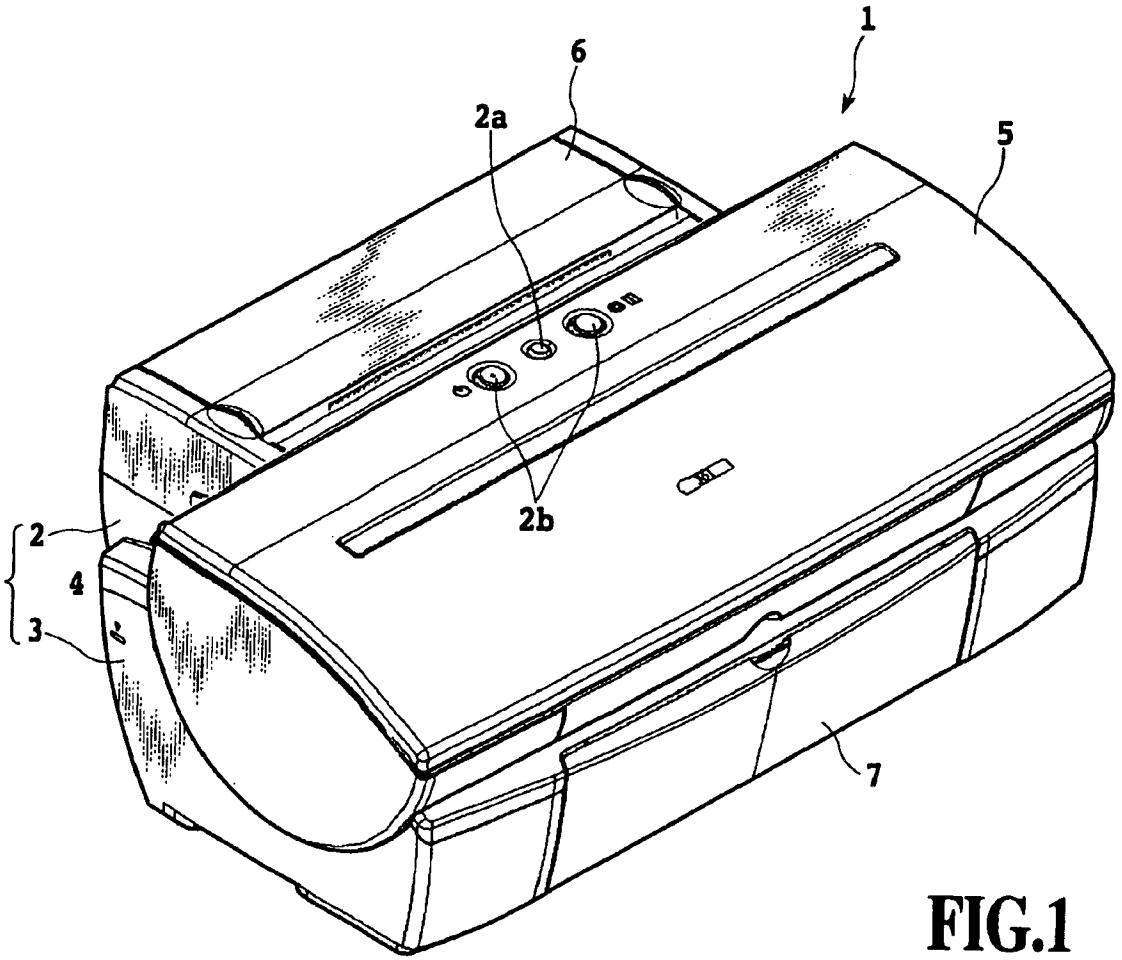
FIG. 1 is a perspective view of an inkjet printing apparatus according to the present invention.

In general, in the case of printing an image on a front end portion and a rear end portion of a printing medium by an inkjet printing apparatus including a roller unit, the printing medium is in a state of being held as a cantilever by the roller unit. Thus, when printing the image on the front end portion and the rear end portion of the printing medium, the relative position relationship between the printing medium and a print head may not accord with a proper relationship (a designed value) due to the characteristics of the printing medium or the effects by the surrounding environment. If ink is ejected from the print head in a state of having an error in the relative position relationship between the printing medium and the print head, the image naturally is degraded.

In the present invention, to prevent this problem in printing an image by a print head on the front or rear end portions of the printing medium held and transported by the roller unit, ink is ejected from a partial number of nozzles of the print head on the side near to the roller unit. Thus, the distances between the nozzles that are allowed to eject ink and the roller unit become smaller compared to the case of ejecting ink from all the nozzles. Therefore, it is possible to restrain the error in the relative position relationship between the print head and the printing medium that is held as a cantilever by the roller unit. Accordingly, the present invention enables reducing the degradation of the image on the front or rear end portions of the printing medium. The present invention also improves the image quality on the front and rear end portions of the printing medium more and allows image printing on the entire surfaces of the printing medium in a high quality.

Further, in the present invention, a transportation roller unit is disposed on an upstream side of the print head in a direction in which the printing medium is transported, and a discharging roller unit is disposed on a downstream side of the print head in a direction in which the printing medium is transported. When only the transportation roller unit holds the printing medium for printing, ink is ejected from a partial number of nozzles on a side near to the transportation roller unit. On the other hand, ink is ejected from a partial number of nozzles on a side near to the discharging roller unit when only the discharging roller unit holds the printing medium for printing. Thus, it is possible to restrain the error in the relative position relationship between the nozzles allowed to eject ink and the printing medium that is held as a cantilever by the roller unit. Accordingly, it is possible to improve the quality of the image on the front ends or the rear ends of printing medium and to obtain print images with a high quality on the entire surfaces of the printing medium by borderless printing.

In this specification, a printing on the front end portion of the printing medium means a printing performed when only the transportation roller unit disposed on the upstream side of the print head holds and transports the printing medium for printing. On the other hand, a printing on the rear end portion of the printing medium means a printing performed when only the discharging roller unit disposed on the downstream side of the print head holds and transports the printing medium for printing.

A preferable embodiment of an inkjet printing apparatus, an inkjet printing method and a program according to the present invention will be described below in detail with the accompanying drawings FIG. 1 is a perspective view of an inkjet printing apparatus according to the present invention. The inkjet printing apparatus 1 of FIG. 1 can perform so-called borderless printing and has a housing 4 including an upper case 2 and a lower case 3. The upper case 2 and the lower case 3 are connected to each other with elastic engaging nails (not shown). An openable access cover 5 is attached to the upper case 2. By opening the access cover 5, it is possible to access to components such as ink tanks disposed in the housing 4 and replace these consumable components.

Figure 2:
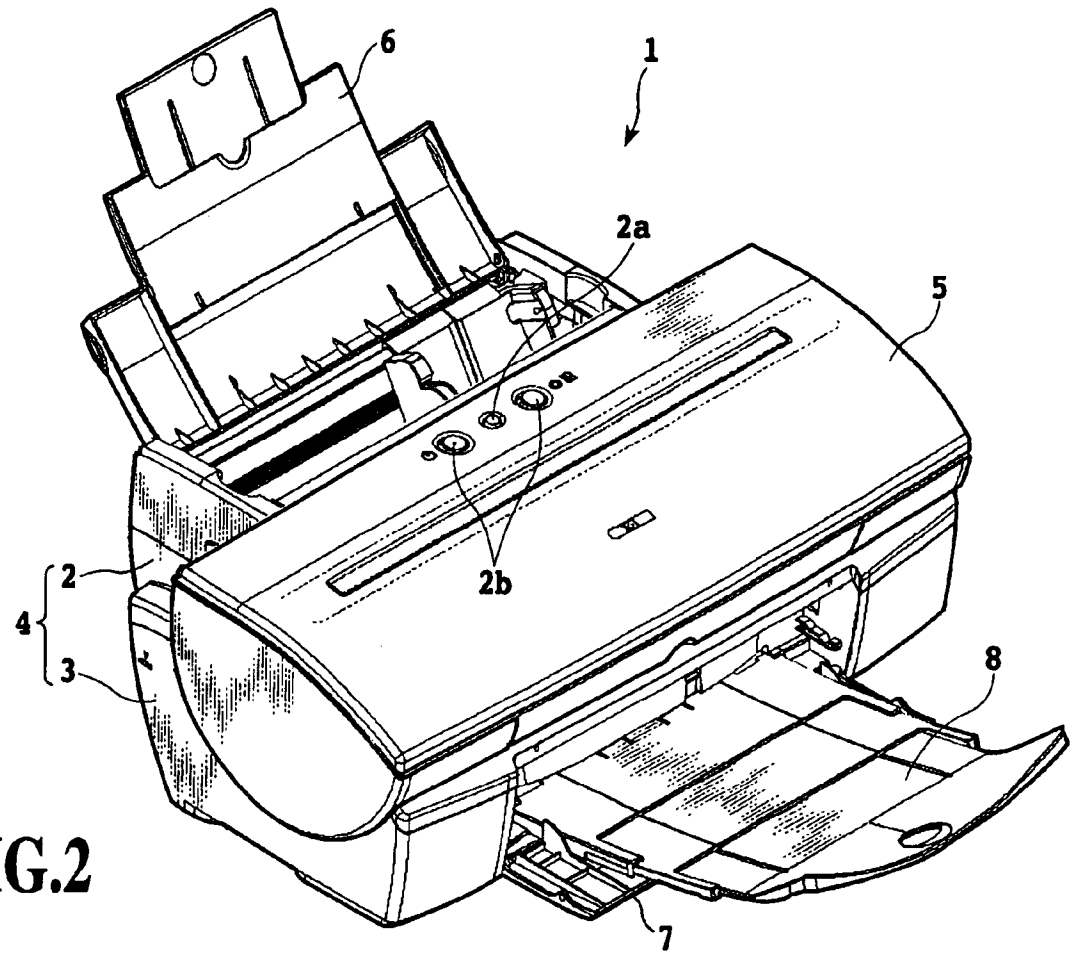
FIG. 2 is another perspective view of the inkjet printing apparatus according to the present invention.

Further, the upper case 2 includes an LED guide 2*a*, a key switch 2*b*, a door switch lever and the like in the upper portion thereof for detection of opening and closing of the access cover 5. Moreover, a feed tray 6 of a multiple stages type is disposed on the upper and rear portion of the case 2. The feed tray 6 is foldable and serves as a cover for preventing exposure of the inside when it is closed as shown in FIG. 1. Printing media can be set on the feed tray 6 by opening and drawing the tray 6 as shown in FIG. 2.

Figure 4:
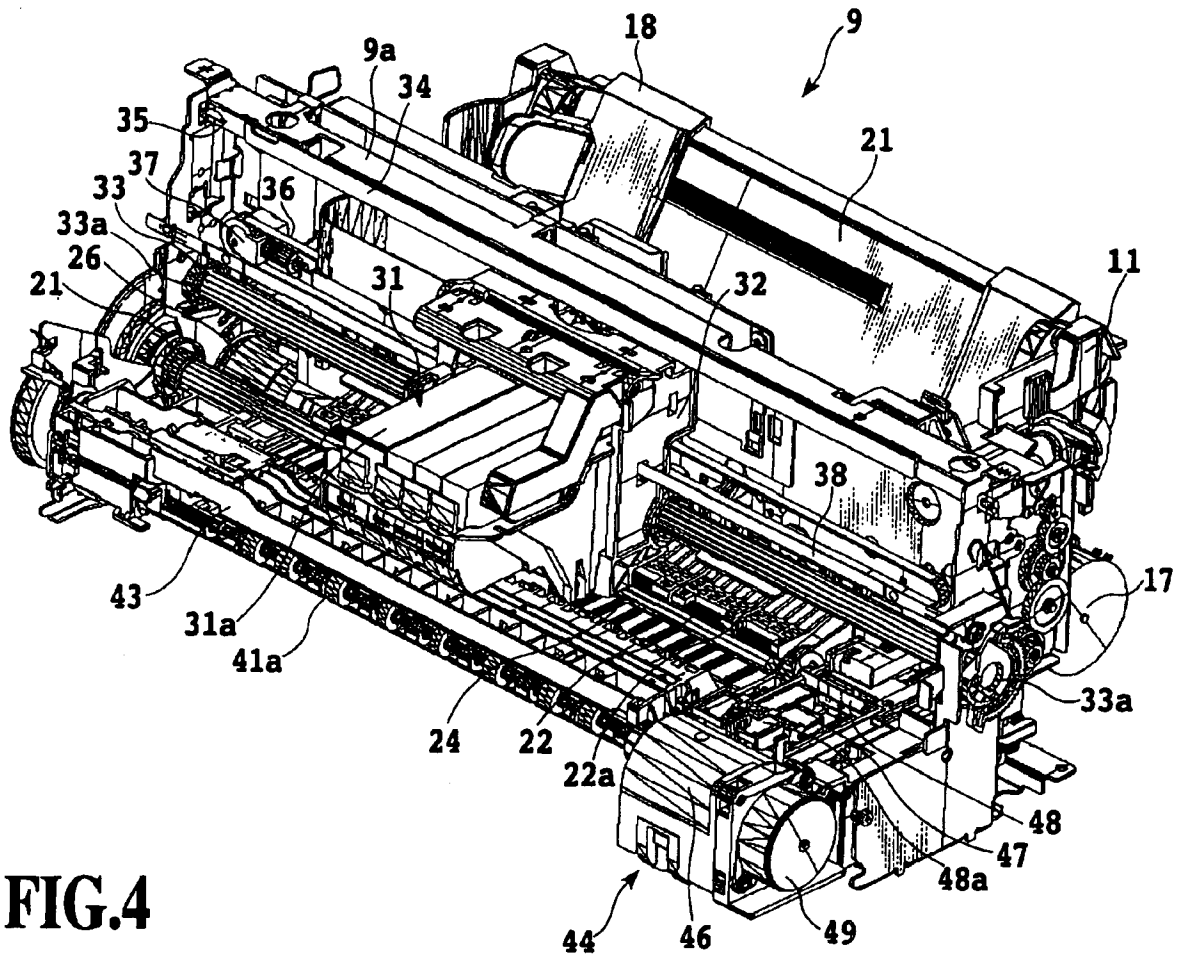
FIG. 4 is another perspective view of the inkjet printing apparatus according to the present invention.
Figure 5:
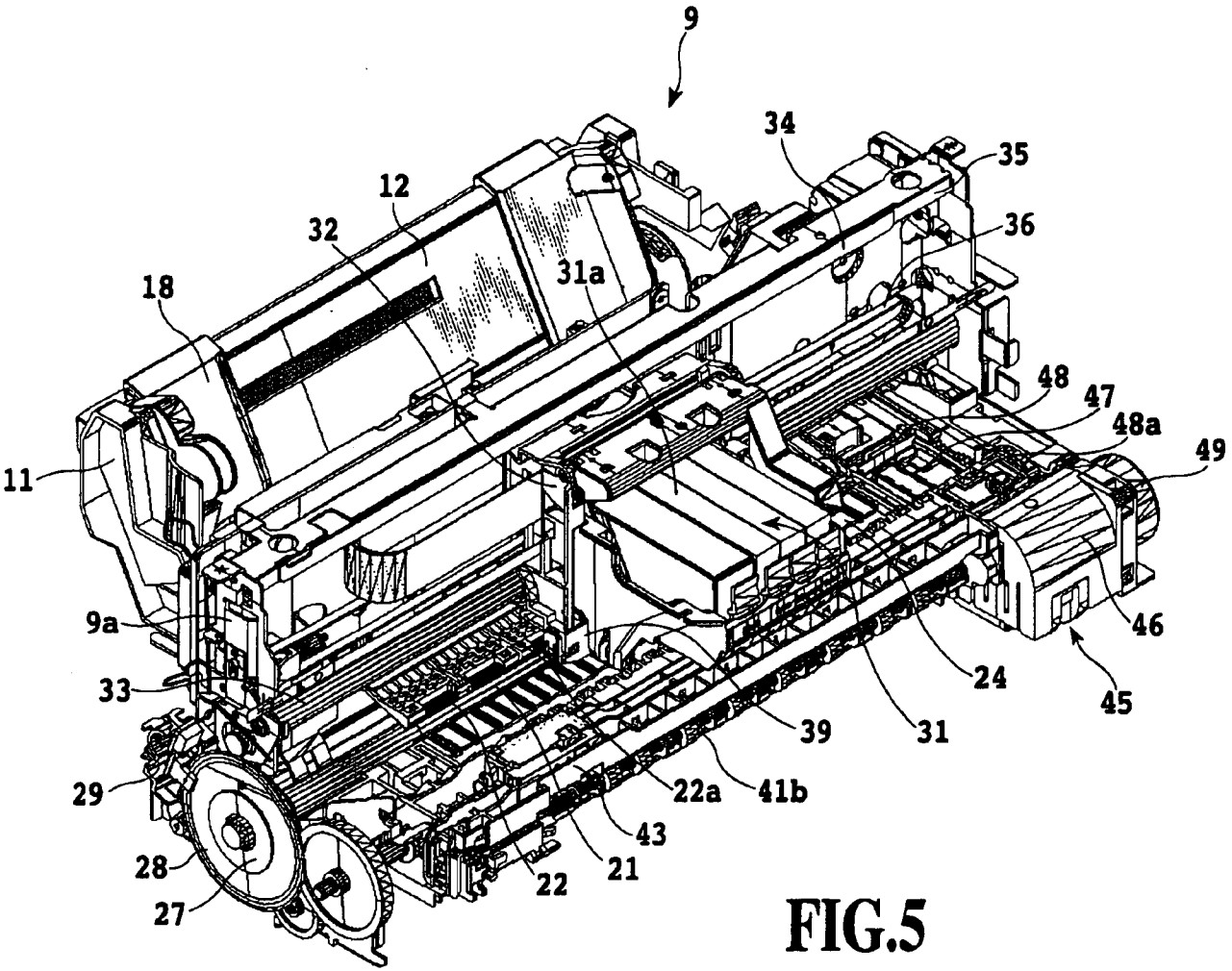
FIG. 5 is another perspective view of the inkjet printing apparatus according to the present invention.

An openable front cover 7 is attached to the lower case 3. The front cover 7 can open and close the discharging opening of the inkjet printing apparatus 1. When the front cover 7 is opened, a discharging tray 8 having an expandable structure can be drawn outside as shown in FIG. 2. Inside the housing 4 constructed as briefly described above, a printing mechanism 9 shown in FIGS. 3 to 5 is disposed.

Figure 3:
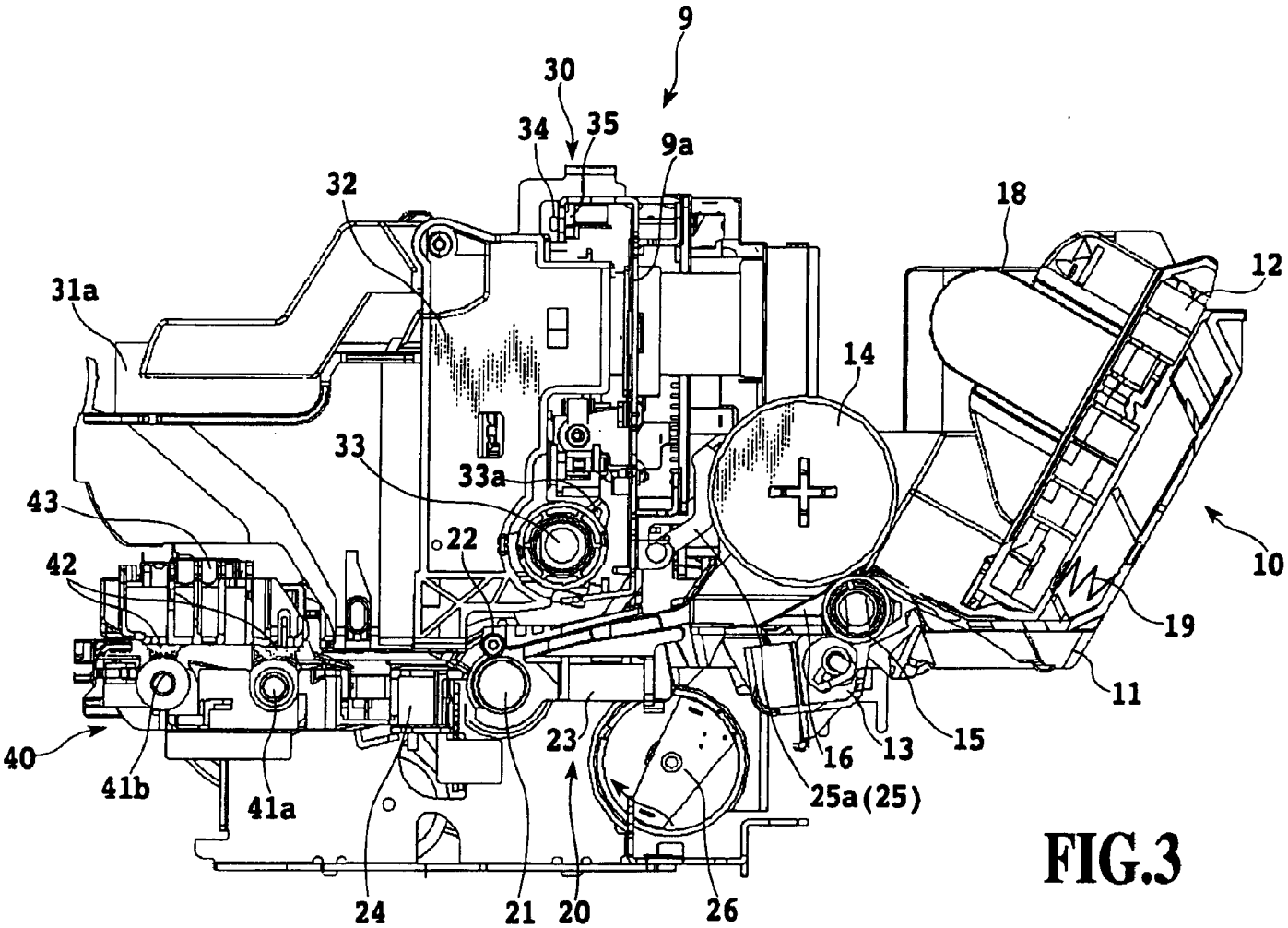
FIG. 3 is a side view of the inkjet printing apparatus according to the present invention.

As shown in FIG. 3, the printing mechanism 9 includes a chassis 9*a*, a feeding mechanism 10, a transportation mechanism 20, a carriage driving mechanism 30, a discharging mechanism 40, a cleaning mechanism 45 and the like. These units will be described below in detail.

(Feeding Mechanism)

A feeding mechanism 10 includes a base 11, a support plate 12 for supporting a printing medium, a feeding roller 14 for feeding the printing medium, a separation roller 15 for separating printing media into single sheet, a return lever 16 for returning the printing medium to a loading position, and the like. The feed tray 6 is attached to the base 11 or the upper case 2, and is drawn to set printing media thereon when it is used. The feeding mechanism 10 further includes a motor 17 (shown in FIG. 4) for feeding the printing medium, and the driving power by the motor 17 is transmitted to the feeding roller 14 by transmission gears, planet gears and the like.

The support plate 12 includes a movable side guide 18, and the movable side guide 18 sets the loading position of printing media. The support plate 12 is rotatably connected to the base 11 and is biased by a spring 19 toward the feeding roller 14. On a part of the support plate 12 opposing to the feeding roller 14, a separation sheet (not shown) made of a material with a comparatively great coefficient of friction such as artificial leather is attached to prevent an overlap of printing media fed by the feeding roller 14 when the number of printing media on the feed tray 6 becomes small. The support plate 12 is driven by a support plate cam (not shown) to contact or leave the feeding roller 14.

Further, the separation roller 15 for separating printing media in to single sheet is supported by a separation roller holder 13. The separation roller holder 13 is rotatably connected to the base 11 and is biased against the feeding roller 14 by a spring (not shown). Further, the separation roller 15 is provided with a clutch spring (not shown) and the separation roller holder 13 rotates when a load greater than or equal to a predetermined load is applied to the separation roller 15. The separation roller 15 is driven by a release shaft (not shown), a control cam and the like so as to contact and leave the feeding roller 14.

The return lever 16 for returning printing media to the loading position is rotatably connected to the base 11 and biased by a spring (not shown) in the releasing direction. When returning the printing medium to the original position, the return lever 16 is driven by a control cam for the separation roller 15. The positions of the support plate 12, the return lever 16 and the separation roller 15 are detected by an ASF sensor (not shown).

When the feeding mechanism 10 is on standby, the support plate 12 is released by a support plate cam, the separation roller 15 is released by a control cam, and the return lever 16 is positioned at a loading position where the opening for loading is covered so that the printing media do not go into the deep when loaded. When the feeding of the printing medium is started from this state, the separation roller 15 contacts the feeding roller 14 by a driving force of the motor 17. Further, the return lever 16 is released and the support plate 12 contacts the feeding roller 14. The printing media are constrained in a front stage separation section (not shown) positioned on the base 11, and only printing media of a predetermined number are fed to a roller nip formed between the feeding roller 14 and the separation roller 15. The printing media are separated at the roller nip, and only one printing medium on the top is transported by the feeding roller 14 and the separation roller 15.

When the printing medium reaches a later described transportation roller 21, the support plate 12 and the separation roller 15 are released by the support plate cam and the control cam respectively, and the return lever 16 is returned to the loading position by the control cam. Meanwhile, the printing media having reached the roller nip formed between the feeding roller 14 and the separation roller 15 are returned to the loading position.

(Transportation Mechanism)

The transportation mechanism 20 includes the transportation roller 21 for transportation of the printing medium. The transportation roller 21 is a metal shaft coated with fine particles of ceramic on the surface thereof and the metallic portions at the both ends of the roller 21 are supported by bearings mounted to the chassis 9*a*. A tension spring for biasing the transportation roller 21 is disposed between the transportation roller 21 and the bearings so as to apply a load to the roller so that transportation is stabilized.

Further, the transportation mechanism 20 includes a plurality of pinch rollers 22 that contact the transportation roller 21 and move following it. Each of pinch rollers 22 is held by a pinch roller holder 22*a* (shown in FIGS. 4 and 5) rotatably connected to the chassis 9*a*, and is pressed against the transportation roller 21 by a spring. These transportation roller 21 and pinch rollers 22 constitute a transportation roller unit for transporting the printing medium.

Further, in the vicinity of the inlet portion of the transportation mechanism 20, a guide flapper 23 for guiding the printing medium and a platen 24 are disposed. The guide flapper 23 is engaged with the transportation roller 21, rotatable around a bearing, and positioned by contacting the chassis 9*a*. The platen 24 is positioned and fixed on the chassis 9*a*. On a reference side of the platen 24, a pressing member for preventing floating of the printing medium by holding an edge of the printing medium is provided. Further, the pinch roller holder 22*a* is provided with a PE sensor lever 25*a* constitutes a PE sensor 25 for detecting the front end and the rear end of the printing medium.

The transportation roller 21 is driven to rotate by a transportation motor 26 which is a DC motor. The driving force of the transportation motor 26 is transmitted to the transportation roller 21 by a timing belt and a pulley 27 (shown in FIG. 5). The transportation roller 21 is provided with a code wheel 28 (shown in FIG. 5) for detecting the amount of the transported printing medium. Markings are formed, with a pitch of 150 to 300 lpi for example, on the code wheel 28, and the markings of the code wheel 28 are read by an encoder sensor 29 disposed on the chassis 9*a* at a position in the vicinity of the code wheel 28.

When the printing medium has been fed from the above described feeding mechanism 10 to the transportation mechanism 20, the printing medium is guided by the pinch roller holder 22*a* and the guide flapper 23 and transported to the transportation roller unit including the transportation roller 21 and pinch rollers 22. Meanwhile, the PE sensor lever 25*a* detects the front end of the transported printing medium to determine a printing position of the printing medium. The printing medium is transported on the platen 24 by the transportation roller 21 which is rotated by the transportation motor 26 and the pinch rollers 22. On the platen 24, a rib which defines a transportation base plane is formed, and the rib controls the gap to a later described print head 31 and restrains waving of the printing medium.

(Carriage Driving Mechanism)

A carriage driving mechanism 30 includes a carriage 32 on which the print head 31 is mounted. To the print head 31, a plurality of ink tanks 31*a* (four colors of C, M, Y, and K in the present embodiment) are detachably mounted. The print head 31 is a so-called inkjet print head having a plurality of nozzles and heaters for providing heat to ink. Ink is film-boiled by the heat generated by the heater. By the pressure change generated by the growth or shrinkage of babbles caused by the film-boiling, the ink is ejected from the nozzles of the print head 31 to form an image on the printing medium.

On the other hand, the carriage 32 is supported by a guide shaft 33 for reciprocatingly moving the carriage 32 in the direction perpendicular to the transportation direction of the printing medium, and by a guide rail 34 for holding the rear end of the carriage 32 to maintain the gap between the print head 31 and the printing medium. The guide shaft 33 is supported by the chassis 9*a*, and the guide rail 34 is integrated into the chassis 9*a*. The guide rail 34 is provided with a sliding sheet 35 of a thin plate of SUS or the like, and the sliding sheet 35 allows reduction of the sliding noise.

The carriage 32 is driven by a carriage motor CRM mounted on the chassis 9*a* through a timing belt 36. The timing belt 36 is supported by an idle pulley 37. The timing belt 36 is connected with the carriage 32 through a damper made of rubber or the like, and the vibration of the carriage motor CRM and the like is damped by the damper so that the degradation of the image due to the vibration is reduced. The carriage driving mechanism 30 includes a code strip 38 for detection of the position of the carriage 32. The code strip 38 is disposed in parallel with the timing belt 36 and has markings formed with a pitch of 150 to 300 lpi for example. The markings of the code strip 38 are read by an encoder sensor which is disposed on a carriage substrate mounted on the carriage 32. The carriage substrate includes a contact for enabling electric connection with the print head 31, and the carriage 32 includes a flexible substrate for transmission of print head signals.

Further, the carriage driving mechanism 30 includes an eccentric cam 33*a* arranged at the both ends of the guide shaft 33. To the eccentric cam 33*a*, the driving force of a carriage elevating motor 39 is transmitted through a gear train so that the guide shaft 33 can be moved up and down. Accordingly, in the inkjet printing apparatus 1, an optimized gap can be provided to printing media having a different thickness by moving up and down the carriage 32.

When printing an image on the printing medium, the printing medium is transported by the transportation roller 21 and the pinch roller 22 (the transportation roller unit) to a line position (a position in the transportation direction of the printing medium) where the image is to be printed, and the carriage 32 is moved by the carriage motor CRM to a row position (a position in the direction perpendicular to the transportation direction of the printing medium) where the image is to be printed. Thus, the print head 31 opposes to an image forming position on the printing medium. Then, the print head 31 is driven to eject ink from a plurality of nozzles thereof.

(Discharging Mechanism)

A discharging mechanism 40 includes two discharging rollers 41*a* and 41*b*, spurs 42 arranged so as to contact with the discharging rollers 41*a* or 41*b* at a predetermined pressure and rotate following the corresponding rollers 41*a* or 41*b*, a gear train (not shown) for transmitting the driving force of the transportation motor 26 to the discharging rollers 41*a* and 41*b*, and the like. The discharging roller 41*a* and the spur 42 opposing thereto constitute a discharging roller unit. The discharging roller 41*b* and the spur 42 opposing thereto also constitute a discharging roller unit. That is, the inkjet printing apparatus 1 includes a plurality (two sets) of discharging roller units.

The discharging roller 41*a* on the upstream side is supported by the platen 24 and includes a metal shaft and a plurality of rubber wheels around the metal shaft. To the discharging roller 41*a* on the upstream side, the driving force of the transportation motor 26 is transmitted through an idler gear and the like. On the other hand, the discharging roller 41*b* on the downstream side includes a shaft of a resin and a wheel made of elastic material such as an elastomer. To the discharging roller 41*b* on the downstream side, a driving force is transmitted from the discharging roller 41*a* through an idler gear and the like.

Each of spurs 42 is made by forming a thin plate of SUS with a plurality of convex portions in the circumference thereof and a resin portion into one body. Each of spurs 42 is mounted on a spur base 43 through a spur spring such as a coil spring and pressed by the spur spring against the corresponding discharging roller 41*a* or 41*b*. The portion of each spur 42 corresponding to the rubber portion of the discharging roller 41*a* or the elastic portion of the discharging roller 41*b* primarily generates force for transportation of the printing medium, and the portion corresponding to the portion other than the rubber portion of the discharging roller 41*a* or the elastic portion of the discharging roller 41*b* primarily restrains the floating of the printing medium.

After the printing by the print head 31, the printing medium with an image is held and transported by the discharging rollers 41*a* and 41*b* and spurs 42 to be ejected onto a discharging tray 8. Between the discharging rollers 41*a* and 41*b*, an end supporting member is disposed for lifting the both end portions of the printing medium and holding the printing medium to prevent causing damage to the image on the printing medium sent out earlier.

(Cleaning Mechanism)

A cleaning mechanism 45 includes a pump 46 for cleaning the print head 31, a cap 47 for restraining the print head 31 from getting dry, a blade 48 for cleaning the face of the print head 31 in the periphery of the nozzles, a cleaning motor 49, and the like. The cleaning motor 49 is provided with a one-way-clutch. The motor 49 drives the pump 46 when it rotates in one direction, and operates the blade 48 and moves the cap 47 up and down when it rotates in the other direction. The blade 48 includes portions for cleaning the print head 31 at the vicinity of the nozzles and portions for cleaning the entire face. The blade 48 and the blade cleaner 48*a* are brought into contact with each other so that ink and the like which adhere the blade 48 are removed.

Figure 6:
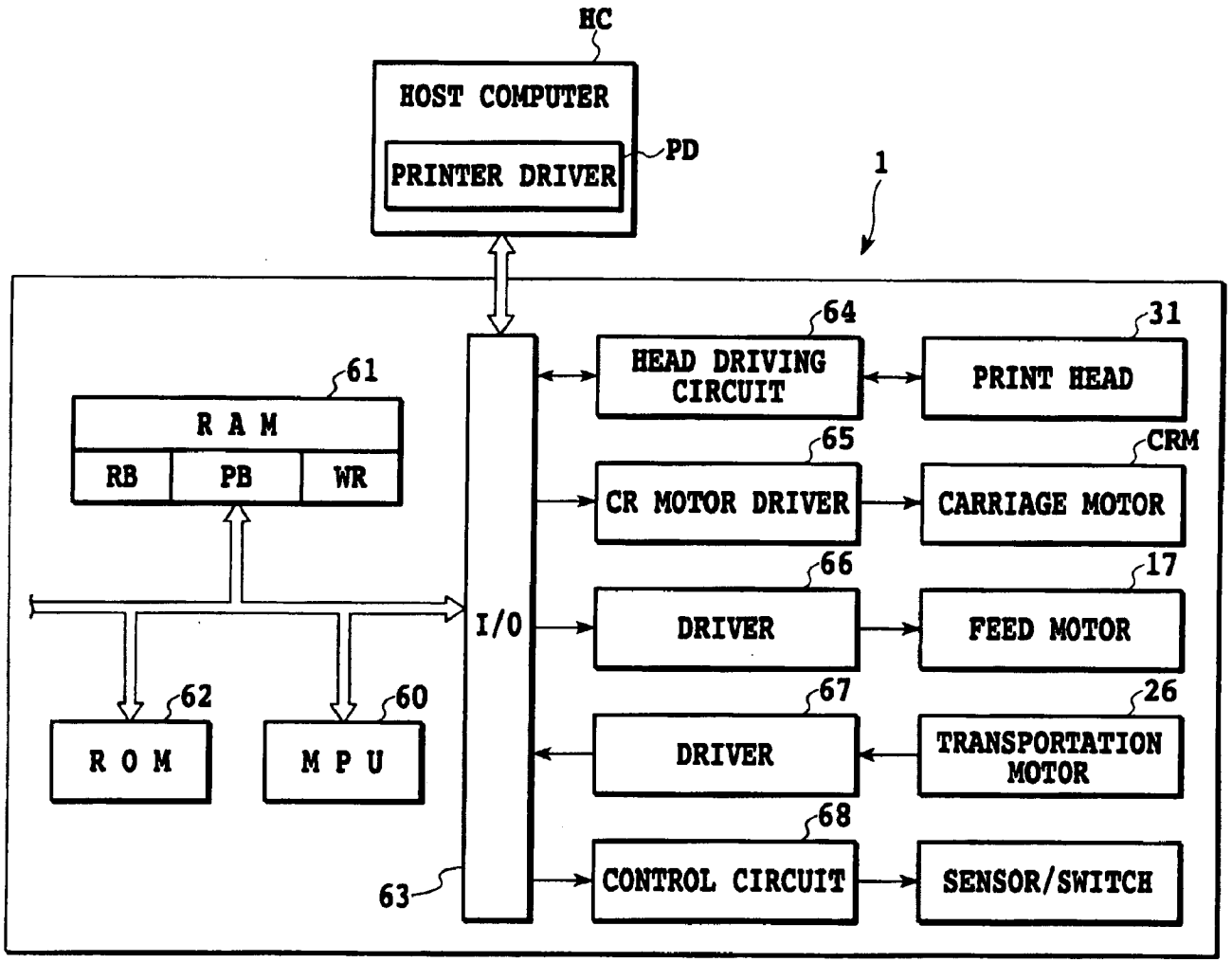
FIG. 6 is a block diagram of the inkjet printing apparatus according to the present invention.

FIG. 6 is a control block diagram of the above described inkjet printing apparatus 1. As shown in FIG. 6, the inkjet printing apparatus 1 includes an MPU 60 serving as a control means of the entire apparatus. A RAM 61 and a ROM 62 are connected to the MPU 60 through a bus line. The Ram 61 includes a receiving buffer RB for temporarily storing various data, a print buffer PB, and a work RAM WR to be used as a working area for processing associated with various controls. The ROM 62 stores programs for various controls and the like.

Further, the MPU 60 is connected with an I/O interface 63 through the bus line, and the I/O interface 63 is connected with an external host computer HC. The print head 31 is connected to the I/O interface 63 through a head driving circuit 64 and is controlled by the MPU 60. Similarly, the carriage motor CRM of the carriage driving mechanism 30 is connected through a CR driver 65, and the motor 17 for feeding the printing medium is connected through a driver 66, to the I/O interface 63. In the same manner, the transportation motor 26 for driving the transportation roller unit and the discharging roller units is also connected to the I/O interface 63 through a driver 67. Further, the above described ASF sensor, the PE sensor 25, the encoder sensor 29, others, and other switches are connected to the I/O interface 63 through a control circuit 68.

Next, the operation of the inkjet printing apparatus 1 will be described in detail with reference to FIGS. 7 to 9. The case of performing borderless printing on a printing medium P will be described here in detail. Of course, the present invention may be applied to the printing other than the borderless printing.

Figure 7:
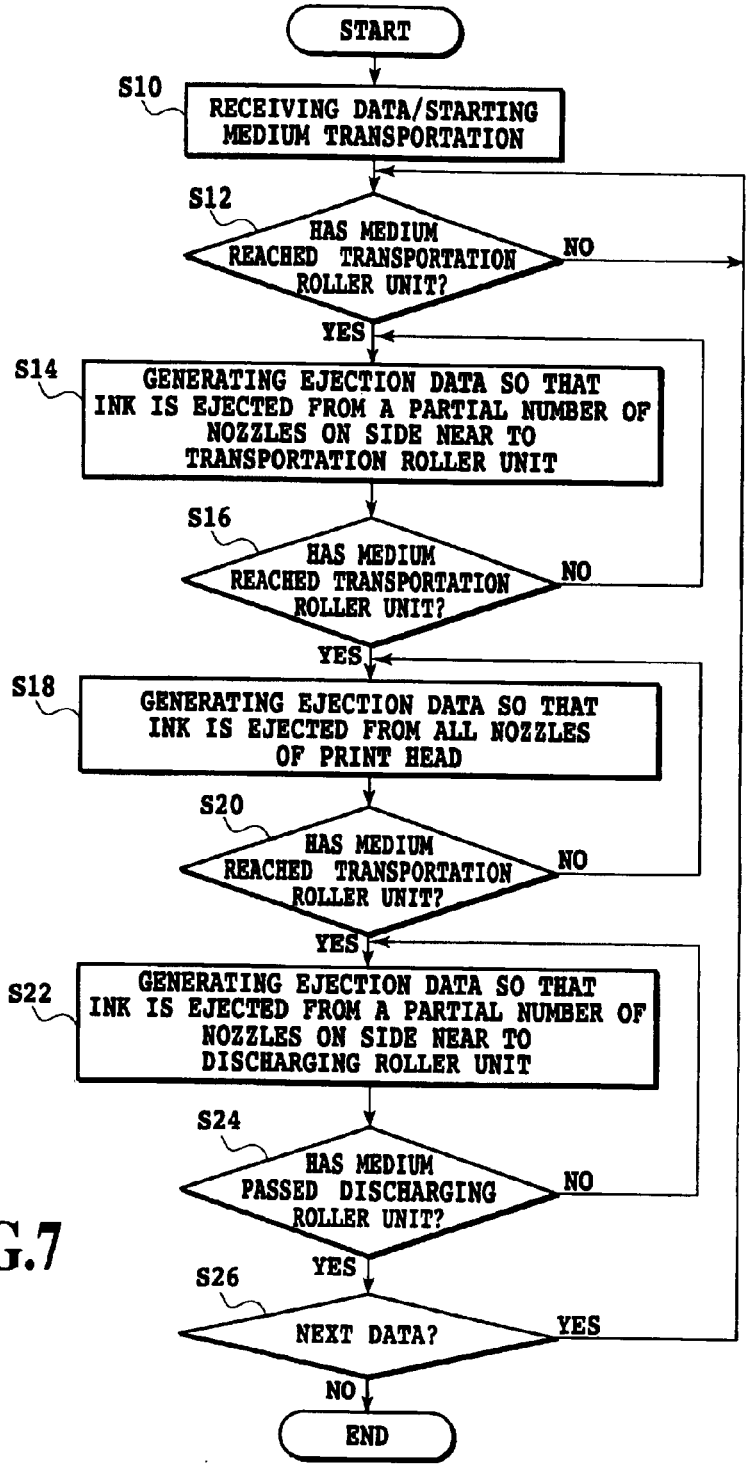
FIG. 7 is a flowchart explaining the operation of the inkjet printing apparatus according to the present invention.

As shown in FIG. 7, data (bitmap data or the like, referred to as 'print data' hereinafter) of images (including characters) to be printed by the inkjet printing apparatus 1 is transmitted from the host computer HC to be stored in the receiving buffer RB of the RAM 61 through the I/O interface 63, and transportation of the printing medium P by the feeding mechanism 10 is started at a predetermined timing (S10). Meanwhile, from the MPU 60, signals for confirmation of normal data transfer, signals for indication of the operation state of the printing apparatus 1, and the like are returned to the host computer HC.

Then, according to signals transmitted from the PE sensor 25, the MPU 60 of the printing apparatus 1 determines whether or not the first printing medium P fed out by the feeding mechanism 10 has reached the transportation roller unit constituted by the transportation roller 21 on the upstream side of the print head 31 and the pinch rollers 22 (S12). When the MPU 60 determines that the printing medium P has reached the transportation roller unit (that is, the printing medium P is held by the transportation roller 21 and the pinch roller 22) in S12, the MPU 60 generates ejection data for performing printing operation by driving the print head 31 according to the print data in the receiving buffer RB, and supplies the ejection data to the head driving circuit 64.

In the process in S14, the MPU 60 of the printing apparatus 1 generates the ejection data so that the ink is ejected only from a partial number of nozzles of the print head 31 located on the side near to the transportation roller unit (the transportation roller 21 and the pinch rollers 22).

Further, the MPU 60 determines whether the printing medium P has reached the discharging roller unit (the discharging roller 41*a* and the spur 42) or not (S16) according to the distance between the nip position of the transportation roller unit and the nip position of the discharging roller unit, the distance being previously stored in a predetermined storage area, and the amount of the ejection data generated by the MPU 60 and the like, or according to a signal from a sensor (not shown). When the MPU 60 determines in S16 that the printing medium P has reached the discharging roller unit (that is, the printing medium P is held by the discharging roller 41*a* and the spur 42), the MPU 60 generates ejection data in such a manner that the ink is ejected from all the nozzles included in the print head 31 (S18).

That is, in the inkjet printing apparatus 1 according to the present invention, while the printing medium P is held only by the transportation roller unit on the upstream side, only partial nozzles on the side near to the transportation roller unit are used to print an image in the process in S12 to S16. Such a process is performed by the following reason.

Figure 8:
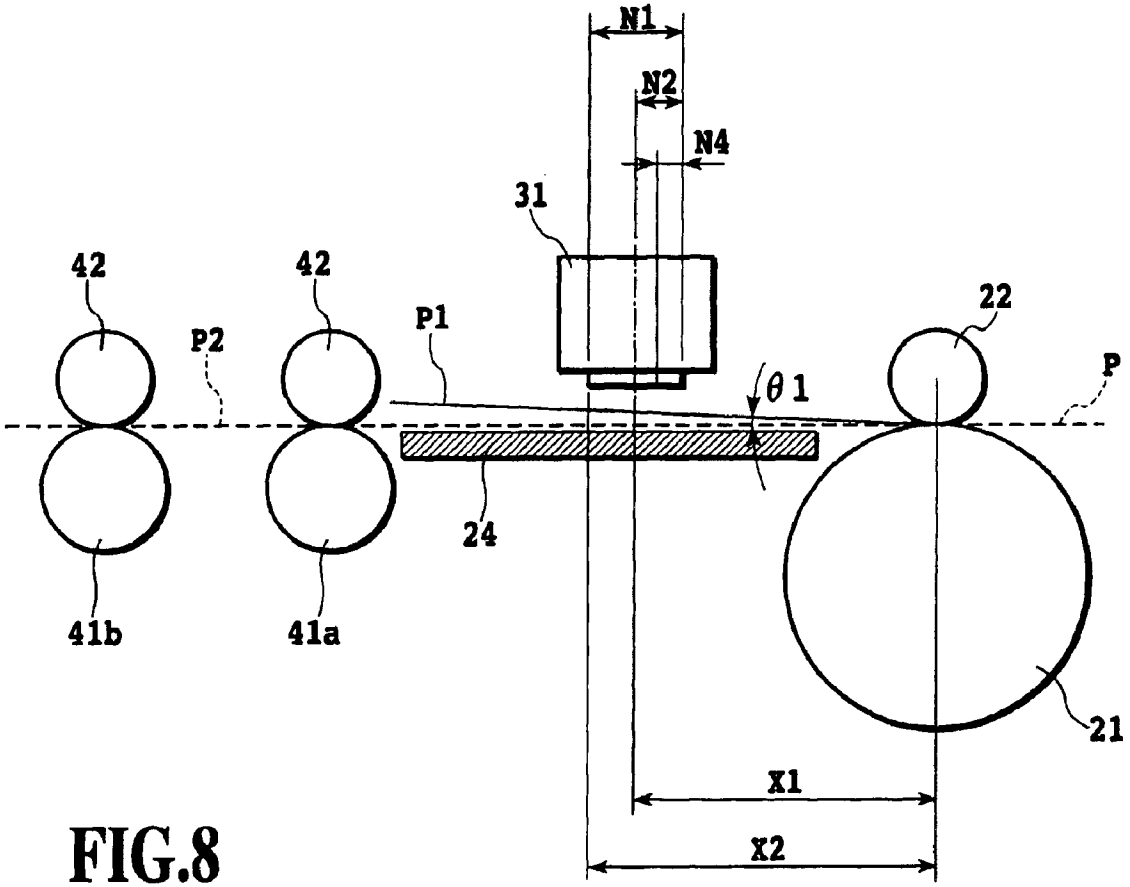
FIG. 8 is a schematic diagram explaining the operation of the inkjet printing apparatus according to the present invention.

In the case of performing borderless printing or printing an image on the front end portion of the printing medium P, the printing medium P is held by the transportation roller unit (the transportation roller 21 and the pinch rollers 22) as a cantilever for a while after getting held by the transportation roller unit, as shown in FIG. 8. This may make the front end of the printing medium float at a certain angle θ1 effected by the characteristics of the printing medium P or the surrounding environment, as shown by "P1" in FIG. 8. This floating phenomenon may occur in the case that the printing medium P is originally curled or a curl is created immediately after printing by a rapid evaporation of ink due to a high printing duty, for example.

In the present embodiment, the print head 31 has 512 nozzles with a nozzle pitch of 600 dpi. Accordingly, the total nozzle length N1 is approximately 21.6 mm in the transportation direction of the printing medium P. The distance X1 from the nip position of the transportation roller unit to the center position of the nozzles is 25 mm in the transportation direction, and the distance X2 from the nip position of the transportation roller unit to the nozzle on the most downstream side is 25+(21.6/2)=35.8 mm.

In such a printing apparatus 1, in the case that a floating of the front end of the printing medium P occurs at an angle θ1=2° for example, if printing is performed using all the nozzles included in the print head 31, the floating amount of the printing medium P in the vicinity of the nozzle on the most downstream side comes to tan 2°×35.8=approximately 1.25 mm from the proper state of the printing medium P (the state that the printing medium P is transported parallel to the platen 24, refer to "P2" in FIG. 8). In this case, the printing medium P is displaced 35.8−cos 2°×35.8=approximately 22 μm as a whole to the upstream side (the transportation roller side) with respect to the transportation direction of the printing medium P. Thus, dots formed on the printing medium P by ink ejected from the print head 31 are moved to the downstream side due to the displaced amount of the position with respect to the transportation direction of the printing medium P.

In contrast, if the front end portion of the printing medium P is held by the discharging roller 41*a* and the spur 42 (that is, the printing medium P is held by the discharging roller unit on the downstream side), the printing medium P gets back to the natural state P2 indicated by a dashed line in FIG. 8. Therefore, the state of transportation of the printing medium P changes between the state before the printing medium P comes to be held by the discharging roller unit (the discharging roller 41*a* and the spur 42), and the state after that. In other words, in the state that the printing medium P is held only by the transportation roller unit and floating of the printing medium P occurs, the relative position relationship between the printing medium P and the print head 31 does not accord with the proper relationship (the designed value). On the other hand, if the printing medium P is held by both the transportation roller unit and the discharging roller unit, the floating of the printing medium P is restrained, and the relative position relationship between the printing medium P and the print head 31 accords with the proper relationship (the designed value).

Accordingly, if the ink is ejected simply from the print head 31 to the front end portion of the printing medium P without taking any measure, the degradation of the image occurs on the printing medium P due to such a change in the transportation state of the printing medium P. A position displacement of a dot of approximately 22 μm exceeds half a pixel (25.4/600/2=approximately 21 μm) of the dot pitch in the printing apparatus 1, and when a user sees an image including such dots, the user perceives the presence of unevenness in the image.

To prevent the problem, in the inkjet printing apparatus 1 according to the present invention, while the printing medium P is held only by the transportation roller unit, that is, from when the printing an image on the front end portion of the printing medium P is started, until when the front end portion of the printing medium P comes to be held by the discharging roller unit (the discharging roller 41*a* and the spur 42), the ink is ejected, for example, only from nozzles (256 nozzles on the upstream side) which are a half (refer to N2 in FIG. 8), on the side near to the transportation unit.

As a result, compared to the case that the ink is ejected from all the nozzles of the print head 31, the distance between the nozzles that eject the ink and the transportation roller unit (the transportation roller 21 and the pinch rollers 22) becomes shorter, which makes it possible to restrain the deviation of the relative position relationship between the print head 31 and the printing medium P held only by the transportation roller unit as a cantilever, even if floating of the sheet occurs. According to the present invention, the degradation of the image on the front end portion of the printing medium P can be reduced. That is, the above described inkjet printing apparatus 1 improves the image quality on the front end portion of the printing medium P more and performs the image printing with a high quality on the entire surface of the printing medium P.

For example, in the case that only half of the nozzles (refer to N2 in FIG. 8) on the transportation roller unit side are used, the floating amount of the printing medium P in the vicinity of the nozzles on the most downstream side is tan 2°×25=approximately 0.87 mm, and the position displacement amount in the transportation direction of the printing medium P in this state is 25−cos 2°×25=approximately 15 μm. Thus, the position displacement in the transportation direction of the printing medium P is reduced in approximately 30% compared to the case of using all the nozzles of the print head 31, and also is below 21 μm which is the reference of the perception of the above described image unevenness.

As shown in FIG. 7, when the MPU 60 of the printing apparatus 1 starts the process in S18, the MPU 60 further determines whether or not the printing medium P has passed the transportation roller unit constituted by the transportation roller 21 and the pinch rollers 22 in accordance with the signal transmitted from the PE sensor 25 (S20). In S20, if the MPU 60 determines that the printing medium P has not passed the transportation roller unit, the MPU 60 generates ejection data so that ink is ejected from all the nozzles included in the print head 31 (S18). That is, after the front end portion of the printing medium P has come to be held by the discharging roller 41*a* and the spur 42, floating of the printing medium P is securely reduced, and accordingly in this case, drop of the throughput can be restrained to the minimum by increasing the printing speed with use of all the nozzles of the print head 31.

On the other hand, in S20, if the MPU 60 determines that the printing medium P has passed the transportation roller unit (that is, the printing medium P is no longer held by the transportation roller 21 and the pinch rollers 22), the MPU 60 generates ejection data so that ink is ejected only from a partial number (half) of nozzles located on the side near to the discharging roller unit (the discharging roller 41*a* and the spur 42 (S22).

Further, the MPU 60 determines whether or not the printing medium P has passed the discharging roller (the discharging roller 41*a* and the spur 42) in accordance with the ejection data amount generated by the MPU 60 and the like, or in accordance with a signal from the sensor not shown (S24). The MPU 60 continues the process in S22 until it determines that the printing medium P has passed the discharging roller unit (the discharging roller 41*a* and the spur 42) in S24.

Figure 9:
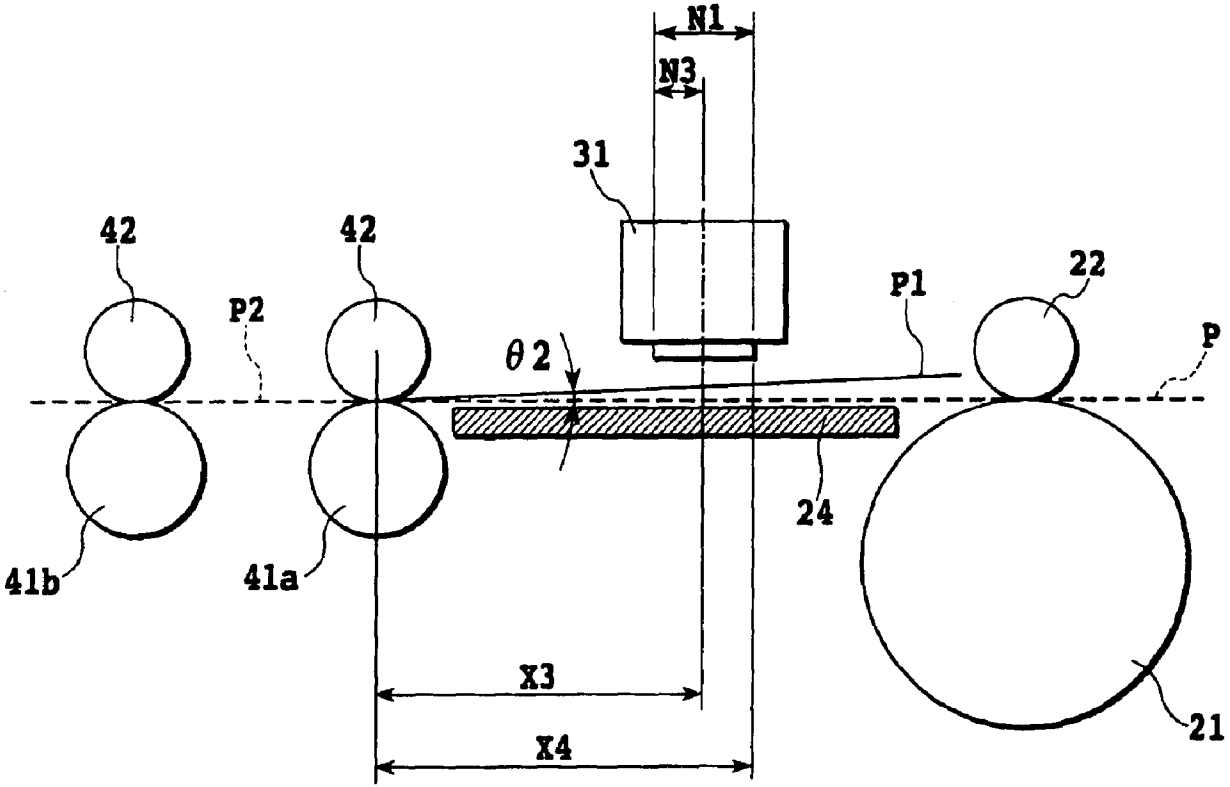
FIG. 9 is another schematic diagram explaining the operation of the inkjet printing apparatus according to the present invention.

In other words, in the case of performing borderless printing or printing an image also on the rear end portion of the printing medium P, the printing medium P is held only by the discharging roller unit (the discharging roller 41*a* and the spur 42) as a cantilever after having passed the transportation roller unit, as shown in FIG. 9. This may make the rear end float at a certain angle θ2 effected by the characteristics of the printing medium P or the surrounding environment, as shown by "P1" in FIG. 9. This floating phenomenon may occur in the case that the printing medium P is originally curled or a curl is created immediately after printing by a rapid evaporation of the ink due to a high printing duty, for example.

Thus, also in the case of printing an image on the rear end portion of the printing medium P, the state of transportation of the printing medium P changes between the state before the printing medium P comes to be held only by the discharging roller unit (the discharging roller 41*a* and the spur 42), and the state after that, as well as in the case of the front end portion of the printing medium P. If ink is ejected simply from the print head 31 to the rear end portion of the printing medium P without taking any measure, the degradation of the image occurs on the printing medium P due to such a change in the transportation state of the printing medium P.

As described above, the print head 31 has 512 nozzles with a nozzle pitch of 600 dpi. Accordingly, the total nozzle length N1 is approximately 21.6 mm in the transportation direction of the printing medium P. The distance X3 from the nip position of the discharging roller unit to the center position of the nozzles is 25 mm in the transportation direction of the printing medium P, and the distance X4 from the nip position of the discharging roller unit to the nozzle on the most upstream side is 25+(21.6/2)=35.8 mm.

In such a printing apparatus 1, in the case that a floating of the rear end of the printing medium P occurs at an angle θ2=20 for example, if printing is performed using all the nozzles included in the print head 31, the floating amount of the printing medium P in the vicinity of the nozzle on the most upstream side comes to tan 2°×35.8=approximately 1.25 mm from the proper state of the printing medium P (the state that the printing medium P is transported parallel to the platen 24, refer to "P2" in FIG. 9). In this case, the printing medium P is displaced 35.8−cos 2°×35.8=approximately 22 μm from the proper position as a whole to the downstream side (the discharging roller side) with respect to the transportation direction of the printing medium P. Thus, dots formed on the printing medium P by ink ejected from the print head 31 are moved to the upstream side due to the displaced amount of the position with respect to the transportation direction of the printing medium P.

Therefore, in the inkjet printing apparatus 1 of the present embodiment, when the sheet comes to be held only by the discharging roller unit, ink is ejected, for example, only from the nozzles (256 nozzles on the downstream side) which is a half (refer to N3 in FIG. 9) on the side near to the discharging roller unit. Thus, compared to the case that ink is ejected from all the nozzles of the print head 31, the distance between nozzles that eject the ink and the discharging roller unit (the discharging roller 41*a* and the spur 42) becomes shorter, which makes it possible to restrain the deviation of the relative position relationship between the print head 31 and the printing medium P held only by the discharging roller unit as a cantilever even if floating of the sheet occurs. According to the present invention, the degradation of the image on the rear end portion of the printing medium P can also be reduced. That is, the above described inkjet printing apparatus 1 improves the image quality on the rear end of the printing medium P more and performs the image printing with a high quality on the entire surface of the printing medium P.

For example, only half of the nozzles (refer to N3 in FIG. 9) on the discharging roller unit side are used for printing an image on the rear end portion of the printing medium P, the floating amount of the printing medium P in the vicinity of the nozzle on the most upstream side out of these nozzles is tan 2°×25=approximately 0.87 mm, and the position displacement amount in the transportation direction of the printing medium P in this state is 25−cos 2°×25=approximately 15 μm. Thus, the position displacement in the transportation direction of the printing medium P is reduced in approximately 30% compared to the case of using all the nozzles of the print head 31, and also is below 21 μm which is the reference of the perception of the above described image unevenness.

As shown in FIG. 7, if the MPU 60 determines that the printing medium P has passed the discharging roller unit (the discharging roller 41*a* and the spur 42) in S24, then the MPU 60 determines, in S26, whether or not next print data is present or not. If the MPU 60 determines that the next print data is present in S26, then the MPU 60 repeats the process in S12 to S24. If the MPU 60 determines that a next print data is not present in S26, then the MPU 60 terminates the printing operation.

In the process in S14 to S22, the nozzles to be used in printing are not limited to the half on the transportation roller unit side or the half of the discharging roller unit side. In other words, the number and the position of the nozzles to be used in printing an image on end portions of the printing medium P can be arbitrarily selected. For example, as shown in FIG. 8, in printing an image on the front end (and/or the rear end) of the printing medium P, only a quarter of all the nozzles on the transportation roller unit (or the discharging roller unit) side may be used. Since dots may not correctly formed on the printing medium P by ink ejected from the nozzles on the most downstream side due to an air current, the ink ejection from the nozzles on the most downstream side may be prohibited. As described above, if the ink is ejected from a small number of nozzles on the side near to the roller unit, the unevenness on the image due to the floating of the printing medium P can be reduced more.

Also, according to the floating (curling) amount of the front or rear end portion of the printing medium P, the position of nozzles to be used for printing may be changed with respect to the transportation direction of the printing medium P. Specifically, if the floating amount of the printing medium P in printing an image on the front or rear end portion of the printing medium P is large, ink may be ejected from a quarter, of all the nozzles, on the transportation roller unit side and/or the discharging roller unit side, and if the floating amount of the printing medium P is small, ink may be ejected from a half, of all the nozzles, on the transportation roller unit side and/or the discharging roller unit side. Thus, it is possible to restrain the position deviation of dots due to the change in the transportation state of the printing medium P is effectively restrained, and minimize the drop in throughput.

In this case, the floating amount can be determined by the print duty. That is, if the print duty is high, the floating (curling) amount can be determined to be large, and if the print duty is low, the floating (curling) amount can be determined to be small. The floating amount also changes with the ambient temperature and humidity of the inkjet printing apparatus 1, and further changes depending on the type (characteristic) of the printing medium.

Therefore, the number and position of the nozzles to be used in S14 and S16 can be changed depending on any one of the print duty, the ambient temperature, and the ambient humidity, or a combination thereof. Further, in the case that the printing medium is a cardboard for example, the cardboard floats little even if it is held by a single roller unit as a cantilever. Accordingly, in the case that the printing medium is a cardboard, ink may be ejected from all the nozzles of the print head 31 for example, and in the case that the printing medium is a usual paper, the ink may be ejected from a partial number of nozzles on the transportation roller unit side and/or the discharging roller unit side.

(Second Embodiment)

In order to effectively reduce the error in the relative position between the nozzles allowed to eject ink and the printing medium, it is ideal to select the nozzles allowed to eject ink as described with respect to above embodiment. That is, ink is ideally ejected from a partial number of nozzles on a side near to the upstream roller unit (transportation roller unit) when only the upstream roller unit holds and transports the printing medium P, and ink is ideally ejected from a partial number of nozzles on a side near to the downstream roller unit (discharging roller unit) when only the downstream roller unit holds and transports the printing medium P. However, in the case that an ink receiver of the platen for receiving ink ejected off the printing medium during borderless printing for providing no margin on at least one end portion of the printing medium has shorter length in the transportation direction of the printing medium than the length of the nozzle array of the print head, ink is ejected not into the ink receiver but on the platen so that the platen is spoiled by ink, if selecting the nozzles allowed to eject ink as described with respect to above embodiment. In such a case, it is necessary to select the nozzles allowed to eject ink in another way. Hereinafter, another way of selecting the nozzles allowed to eject ink will be described in connection with the borderless printing in the case that the ink receiver of the platen has shorter length than the nozzle array of the print head.

Figure 10:
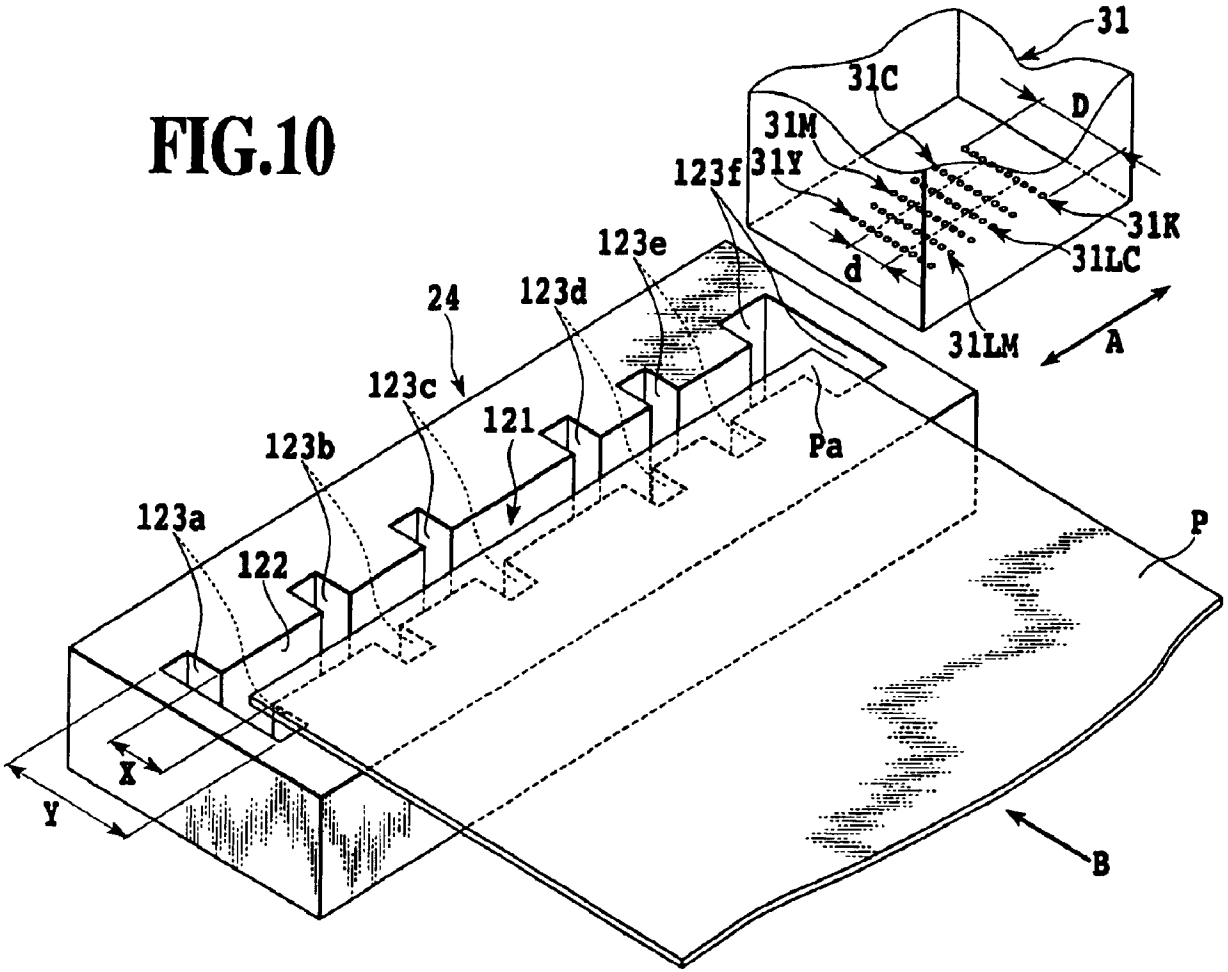
FIG. 10 is an enlarged perspective view of a second embodiment of the inkjet printing apparatus of the present invention.

As shown in FIG. 10, a platen 24 is disposed in the housing 4 to be opposite to the print head 31 which reciprocates in the main scanning direction. The platen 24 defines the position of the printing medium P when an image is printed thereon. In the inkjet printing apparatus 1, the feeding mechanism 10 transports printing medium P to the platen 24 in the transportation direction (direction B indicated by an arrow). The carriage 32 moves in the main scanning direction (direction A), while the print head 31 ejects ink onto the printing medium P on the platen 24. As a result, an image is printed on printing medium P. The print head 31 is driven in accordance with ink ejection data, and the print head 31 ejects ink to print images.

An ink receiver 121 is formed on the platen 24 to be opposite to each of the nozzle arrays 31K–31Y of the print head 31. During borderless printing on the end portions of printing medium P, the print head 31 ejects the black ink and color inks to the ink receiver 121 beyond printing medium P. The ink receiver 121 extends along the main scanning direction (direction A in the figure). The ink receiver 121 includes a primary depressed portion 122 and a plurality of secondary depressed portions 123*a*–123*f*. The primary depressed portion 122 is longer than the width of the widest printing medium P which can be used in the inkjet printing apparatus 1. Further, the primary depressed portion 122 has a length X shorter than the length D of the nozzle arrays 31K–31Y (length in the transportation direction of the printing medium P). The secondary depressed portions 123*a*–123*f* are formed in the platen 24 in the positions each corresponding to the side edge of each of the printing media P such as A4 paper sheets, postcards and the like. The secondary depressed portions 123*a*–123*f* extend from the primary depressed portion 122 to both upstream and downstream directions in the transportation direction (direction B) of printing medium P. The secondary depressed portions 123*a*–123*f* have a length "Y" in the transportation direction of the printing medium P. The length "Y" is a little longer than the length "D" of the nozzle arrays 3K–3Y of the print head 31.

Moreover, the primary depressed portion 122 opposes to only the upstream nozzles and does not oppose to the downstream nozzles. Thus, if ink is ejected from the print head 31 in the state where the printing medium P is not transported, all the ink ejected from the upstream nozzles is received into the ink receiver 121 while almost all the ink ejected from the downstream nozzles is received on the platen 24.

In the above described configuration, if the nozzles allowed to eject ink are selected as described with respect to above embodiment, only the downstream nozzles that do not oppose to the ink receiver 121 are selected as the nozzles always allowed to eject ink for printing an image on the rear end portion of the printing medium P. In such a case, all the ink ejected from the downstream nozzles is satisfactorily received on the printing medium P until a predetermined time has been passed after a transportation of the printing medium P by the discharging roller unit is started (until scanning of the print head of predetermined numbers has completed after the use of only the downstream nozzles are started). Thus, it is possible to reduce the error in the relative position between the nozzles allowed to eject ink and the printing medium P. However, when the printing an image on the rear end portion of the printing medium P is started, ink is ejected off the printing medium P from the downstream nozzles that do not oppose to the ink receiver 121 so that the ink is received on the platen 24. This is not preferable because ink spoils the platen.

In the second embodiment, only the downstream nozzles are allowed to eject ink until the predetermined time has been passed after the transportation of the printing medium P by the discharging roller unit is started (until scanning of the print head of predetermined numbers has completed after the use of only the downstream nozzles are started). Then, only the upstream nozzles are allowed to eject ink after the predetermined time has been passed.

In short, the borderless printing is performed in accordance with following steps in the second embodiment. That is, when the printing medium P is held and transported only by the upstream roller unit (transportation roller unit) for printing an image on the front end portion of the printing medium P, only the partial number of nozzles on a side near to the upstream roller unit are selected as the nozzles allowed to eject ink. Then, all of nozzles of the print head 31 are selected as the nozzles allowed to eject ink when the printing medium P is held and transported by both the up stream and downstream roller units (both the transportation roller unit and the discharging roller unit) for ordinary printing. Further, when the printing medium P is held and transported only by the downstream roller unit (discharging roller unit) for printing an image on the rear end portion of the printing medium P, only the partial number of nozzles on a side near to the downstream roller unit are selected as the nozzles allowed to eject ink until the predetermined time has been passed after the transportation of the printing medium P by the discharging roller unit is started. Then, only the upstream nozzles are allowed to eject ink after the predetermined time has been passed.

According to the second embodiment of the present invention, it is possible to reduce the error in the relative position between the nozzles allowed to eject ink and the printing medium P and to prevent the platen 24 from being spoiled by ink, even if the primary depressed portion 122 has a length X shorter than the length D of the nozzle arrays 31K–31Y.

In addition, the nozzles allowed to eject ink may gradually shifted from the downstream side to the upstream side before the predetermined time has been passed after the transportation of the printing medium P by the discharging roller unit is started. That is, the downstream nozzles and the upstream nozzles are simultaneously allowed to eject ink. The upstream nozzles come to be allowed to eject ink finally.

Further, the primary depressed portion 122 of the platen 24 may oppose to only the downstream nozzles and may not oppose to the downstream nozzles. In such a configuration, when the printing medium P is held and transported only by the upstream roller unit (transportation roller unit), only the partial number of nozzles on a side near to the upstream roller unit are initially selected as the nozzles allowed to eject ink, then, the downstream nozzles are selected. When the printing medium P is held and transported only by the downstream roller unit (discharging roller unit), only the partial number of nozzles on a side near to the downstream roller unit are selected as the nozzles allowed to eject ink.

Moreover, the primary depressed portion of the platen 24 may oppose all of the upstream nozzles and a part of the downstream nozzles. In such a configuration, when the printing medium P is held and transported only by the upstream roller unit (transportation roller unit), only the partial number of nozzles on a side near to the upstream roller unit are selected as the nozzles allowed to eject ink. When the printing medium P is held and transported only by the downstream roller unit (discharging roller unit), only the partial number of nozzles on a side near to the downstream roller unit are initially selected as the nozzles allowed to eject ink, then, only the upstream nozzles are selected or the upstream nozzles and the downstream nozzles opposing to the ink receiver are selected or only the downstream nozzles opposing to the ink receiver are selected.

(Other Embodiments)

The present invention can be applied also to printing apparatuses having no discharging roller unit (a discharging roller 41*a* and a spur 42, and a discharging roller 41*b* and a spur 42). In such a configuration, since the front end of the printing medium is not held by a discharging roller unit, the effects by the floating of the printing medium may be smaller compared to a printing apparatus having a discharging roller unit. However, since the floating amount of the printing medium changes with effects by the weight of the printing medium itself, the characteristics of the printing medium, or the ambient environment, the present invention can be applied to allow adequate reduction in the degradation of the image due to the floating of the sheet. By the same reason, the present invention may be applied to a printing apparatus having only a discharging roller unit and no transportation roller unit. Any of the specific numbers or the like described in association with the above described embodiment is an example and does not limit the invention at all.

Of course, the present invention may be applied to the printing other than the borderless printing (printing for providing a margin on at least one end portion of the printing medium). In short, the present invention can be applied to at least one of (a) operation for printing an image on the front end portion of the printing medium when the printing medium is held and transported only by the transportation roller unit; and (b) operation for printing an image on the rear end portion of the printing medium when the printing medium is held and transported only by the discharging roller unit.

Further, all or a part of the series of processes shown in the flowchart in FIG. 7 can be performed also by a printer driver PD on the host computer HC. For example, on the printer driver PD of the host computer HC, print data may be generated so that the ink is ejected only from a partial number of nozzles on the side near to the transportation roller unit or the discharging roller unit for printing an image on the front end or the rear end of the printing medium, and on the printing apparatus, only printing operation may be performed in accordance with data transferred from the host computer HC.

The objective of the present invention may also be achieved by providing an apparatus or system with a storage medium which stores software program code capable of realizing the functions described in the above embodiments. The computer (CPU or MPU) of such apparatus or system reads and executes the program code stored in the storage medium.

In such a case, the program code itself realizes the functions of the above embodiments. The storage medium storing the program code and program code itself are included in the scope of the present invention.

The storage medium of the present invention stores the program code corresponding to the flowchart of FIG. 7, for example. In this case, the program code corresponding to S12–S24 in the flowchart of FIG. 7 is important. In other words, the important program code is that for generation of ink ejection data so that ink is ejected from a partial number of nozzles on the side near to one of roller units (the transportation roller unit or the discharging roller unit) when the printing medium is held only by the one of the roller units for printing an image on the front end or the rear end of the printing medium.

Storage media for storing the program include, for example, a floppy (registered trademarks) disk, a CD-ROM, a hard disk devise, an optical disk, a magnetic optical disk, a CD-R, a CD-RW, a DVD, a magnetic tape, anon-volatile memory card, a ROM, etc.

Further, the functions of the above-mentioned embodiments can be achieved by a computer that read out the program of the present invention and executes the program. Moreover, the Operating System on the computer may execute all or a part of the actual process in accordance with the instruction from the program. Such operations are also included in the scope of the present invention.

Further, the program stored in a storage medium may be written into a function extended board inserted into a computer or into memory of a function extended unit connected to a computer, and the function extended board or a CPU of the function extended unit can execute all or a part of the actual processes. Such operations are also included in the scope of the present invention.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An inkjet printing apparatus capable of printing an image on a printing medium by performing an operation for ejecting ink from a print head including a plurality of nozzles onto said printing medium in accordance with print data while moving said print head and an operation for feeding a printing medium in a direction substantially perpendicular to a direction in which said print head is moved, said apparatus comprising:

a roller unit for transporting said printing medium, wherein ink is ejected from a partial number of nozzles on a side near to said roller unit which transports said printing medium when printing an image on both a front end portion and a rear end portion of said printing medium.

2. The inkjet printing apparatus according to claim 1, wherein said roller unit includes a first roller unit disposed on an upstream side of said print head in a direction in which said printing medium is transported, and a second roller unit disposed on a downstream side of said print head in a direction in which said printing medium is transported, and wherein said front end portion of said printing medium corresponds to an area on which an image is printed when only said first roller unit transports said printing medium, and wherein said rear end portion of said printing medium corresponds to an area on which an image is printed when only said second roller unit transports said printing medium.

3. An inkjet printing apparatus capable of printing an image on a printing medium by ejecting ink in accordance with print data from a print head including a plurality of nozzles, comprising:

a first roller unit for holding and transporting said printing medium, said first roller unit disposed on an upstream side of said print head in a direction in which said printing medium is transported;

a second roller unit for holding and transporting said printing medium, said second roller unit disposed on a downstream side of said print head in a direction in which said printing medium is transported;

wherein ink is ejected from a partial number of nozzles on a side near to said first roller unit when only said first roller unit holds said printing medium for printing, and wherein ink is ejected from a partial number of nozzles on a side near to said second roller unit when only said second roller unit holds said printing medium for printing.

4. An inkjet printing apparatus capable of printing an image on a printing medium by ejecting ink in accordance with print data from a print head including a plurality of nozzles, comprising:

a first roller unit for holding and transporting said printing medium, said first roller unit disposed on an upstream side of said print head in a direction in which said printing medium is transported;

a second roller unit for holding and transporting said printing medium, said second roller unit disposed on a downstream side of said print head in a direction in which said printing medium is transported; and a determining means for determining which nozzles are allowed to eject ink in accordance with a position of said printing medium in a transporting path;

wherein said determining means determines a partial number of nozzles on a side near to said first roller unit as said nozzles being allowed to eject ink when said printing medium is positioned to be held only by said first roller unit, and wherein said determining means determines a partial number of nozzles near to said first roller unit and a partial number of nozzles near to said second roller unit as said nozzles being allowed to eject ink when said printing medium is positioned to be held by both said first roller unit and said second roller unit, and wherein said determining means determines a partial number of nozzles on a side near to said second roller unit as said nozzles being allowed to eject ink when said printing medium is positioned to be held only by said second roller unit.

5. An inkjet printing apparatus capable of printing an image on a printing medium by ejecting ink in accordance with print data from a print head including a plurality of nozzles, comprising:

a roller unit for holding and transporting said printing medium, wherein ink is ejected from a partial number of nozzles on a side near to said roller unit which holds said printing medium when printing an image on both a front end portion and a rear end portion of said printing medium.

6. The inkjet printig apparatus according to claim 5, further comprising an ejection data generating means for generating ink ejection data for driving said print head in accordance with said print data, wherein said ejection data generating means generates said ink ejection data so that ink is ejected from said partial number of nozzles on said side near to said roller unit which holds said printing medium when printing an image on both a front end portion and a rear end portion of said printing medium.

7. The inkjet printing apparatus according to claim 5, wherein said roller unit includes a transportation roller unit disposed on an upstream side of said print head in a transportation direction of said printing medium, and wherein ink is ejected from a partial number of nozzles on a side near to said transportation roller unit when printing an image on a front end portion of said printing medium while said printing medium is held only by said transportation roller unit.

8. The inkjet printing apparatus according to claim 7, wherein said roller unit includes a discharging roller unit disposed on a downstream side of said print head in the transportation direction of said printing medium, and wherein ink is ejected from a partial number of nozzles on a side near to said discharging roller unit when printing an image on a rear end portion of said printing medium while said printing medium is held only by said discharging roller unit.

9. The inkjet printing apparatus according to claim 8, wherein ink is ejected from a partial number of nozzles on a side near to said transportation roller unit after printing an image on a front end portion of said printing medium is started and until said front end portion of said printing medium is held by said discharging roller unit.

10. The inkjet printing apparatus according to claim 8, comprising a plurality of discharging roller units.

11. The inkjet printing apparatus according to claim 4, wherein the nozzles being allowed to eject ink are determined in accordance with a curling state of said printing medium.

12. The inkjet printing apparatus according to claim 11, wherein said curling state is determined in accordance with any one of a print duty, an ambient temperature, and an ambient humidity, or a combination thereof.

13. The inkjet printing apparatus according to claim 4, wherein the nozzles being allowed to eject ink are determined in accordance with a type of said printing medium.

14. An inkjet printing method comprising a step of:

printing an image on a printing medium by performing an operation for ejecting ink from a print head including a plurality of nozzles onto said printing medium in accordance with print data while moving said print head and an operation for feeding a printing medium in a direction substantially perpendicular to a direction in which said print head is moved, wherein ink is ejected from a partial number of nozzles on a side near to a roller unit which transports said printing medium when printing an image on both a front end portion and a rear end portion of said printing medium.

15. The inkjet printing method according to claim 14, wherein said roller unit includes a first roller unit disposed on an upstream side of said print head in a direction in which said printing medium is transported, and a second roller unit disposed on a downstream side of said print head in a direction in which said printing medium is transported, and wherein said front end portion of said printing medium corresponds to an area on which an image is printed when only said first roller unit transports said printing medium, and wherein said rear end portion of said printing medium corresponds to an area on which an image is printed when only said second roller unit transports said printing medium.

16. An inkjet printing method for printing an image on a printing medium by ejecting ink in accordance with print data from a print head including a plurality of nozzles, comprising the steps of:

holding and transporting said printing medium by a first roller unit disposed on an upstream side of said print head in a direction in which said print head is transported;

holding and transporting said printing medium by a second roller unit disposed on a downstream side of said print head in a direction in which said printing medium is transported;

ejecting ink from a partial number of nozzles on a side near to said first roller unit when only said first roller unit holds said printing medium for printing; and ejecting ink from a partial number of nozzles on a side near to said second roller unit when only said second roller unit holds said printing medium for printing.

17. An inkjet printing method for printing an image on a printing medium by ejecting ink in accordance with print data from a print head including a plurality of nozzles, comprising the steps of:

holding and transporting said printing medium by a first roller unit disposed on an upstream side of said print head in a direction in which said printing medium is transported;

holding and transporting said printing medium by a second roller unit disposed on a downstream side of said print head in a direction in which said printing medium is transported; and determining which nozzles are allowed to eject ink in accordance with a position of said printing medium in a transporting path, said determining step including the steps of:

(a) determining a partial number of nozzles on a side near to said first roller unit as said nozzles being allowed to eject ink when said printing medium is positioned to be held only by said first roller unit;

(b) determining a partial number of nozzles near to said first roller unit and a partial number of nozzles near to said second roller unit as said nozzles being allowed to eject ink when said printing medium is positioned to be held by both said first roller unit and said second roller unit; and (c) determining a partial number of nozzles on a side near to said second roller unit as said nozzles being allowed to eject ink when said printing medium is positioned to be held only by said second roller unit.

18. An inkjet printing method for printing an image on a printing medium by ejecting ink in accordance with print data from a print head including a plurality of nozzles, comprising a step of:

ejecting ink from a partial number of nozzles on a side near to a roller unit which holds said printing medium when printing an image on both a front end portion and a rear end portion of said printing medium.

19. A program for controlling an inkjet printing apparatus including a roller unit for transporting a printing medium and capable of printing an image on a printing medium transported by said roller unit by ejecting ink in accordance with print data from a print head including a plurality of nozzles, said program comprising:

computer-readable program code means for generating ink ejection data so that ink is ejected from a partial number of nozzles on a side near to said roller unit which holds said printing medium when printing an image on both a front end portion and a rear end portion of said printing medium.

* * * * *

UNITED STATES PATENT AND TRADEMARK OFFICE

CERTIFICATE OF CORRECTION

PATENT NO. : 6,908,168 B2
DATED : June 21, 2005
INVENTOR(S) : Koichiro Kawaguchi It is certified that error appears in the above-identified patent and that said Letters Patent is hereby corrected as shown below:

Column 6,
Line 24, “opposing to” should read -- opposing --.

Column 9,
Line 30, “the both” should read -- both the --.

Column 14,
Line 36, “not” should read -- not be --.

Column 16,
Line 34, “printing” should read -- printing of --.

Column 17,
Line 10, “may” should read -- may be --.
Line 63, “to the” should read -- to --.
Line 64, “the borderless” should read -- borderless --.

Signed and Sealed this

Third Day of January, 2006

JON W. DUDAS
*Director of the United States Patent and Trademark Office*